US008272883B1

(12) United States Patent
Smith

(10) Patent No.: US 8,272,883 B1
(45) Date of Patent: Sep. 25, 2012

(54) INTERSYSTEM GROUNDING BRIDGE AND SYSTEM

(75) Inventor: Lawrence J. Smith, Stamford, CT (US)

(73) Assignee: Bridgeport Fittings, Inc., Stratford, CT (US)

( * ) Notice: Subject to any disclaimer, the term of this patent is extended or adjusted under 35 U.S.C. 154(b) by 0 days.

(21) Appl. No.: 13/136,872

(22) Filed: Aug. 12, 2011

(51) Int. Cl.
*H01R 13/648* (2006.01)

(52) U.S. Cl. ..... 439/95

(58) Field of Classification Search ..... 439/95, 439/91, 92, 96, 98, 100, 101
See application file for complete search history.

(56) References Cited

U.S. PATENT DOCUMENTS

| | | | | |
|---|---|---|---|---|
| 3,133,779 | A | 5/1964 | Stanback | |
| 4,189,198 | A * | 2/1980 | Reichman | 439/100 |
| 4,223,179 | A * | 9/1980 | Lusk et al. | 174/73.1 |
| 4,231,633 | A | 11/1980 | Luke et al. | |
| 4,806,108 | A * | 2/1989 | Meinhardt | 439/100 |
| 4,954,084 | A * | 9/1990 | Pugh et al. | 439/29 |
| 5,848,913 | A | 12/1998 | Ashcraft | |
| 6,939,183 | B2 | 9/2005 | Ferretti et al. | |
| 7,056,161 | B2 * | 6/2006 | Delcourt et al. | 439/766 |
| 7,134,921 | B2 | 11/2006 | Siracki et al. | |
| 7,281,932 | B2 | 10/2007 | Cheng et al. | |
| 7,537,467 | B1 | 5/2009 | Gretz | |
| 7,563,100 | B1 * | 7/2009 | Smith | 439/33 |
| 7,591,656 | B1 | 9/2009 | Gretz | |
| 8,007,284 | B2 * | 8/2011 | Smith | 439/32 |
| 2005/0202732 | A1 | 9/2005 | Rizzo et al. | |
| 2009/0258520 | A1 * | 10/2009 | Smith | 439/271 |
| 2010/0071954 | A1 * | 3/2010 | Kiely et al. | 174/88 R |
| 2010/0218992 | A1 * | 9/2010 | Smith | 174/84 R |
| 2012/0086196 | A1 * | 4/2012 | Smith | 285/31 |

OTHER PUBLICATIONS

Ilsco; Ilsco ClearChoice Connectors; Advertisement for ClearGround Intersystem Bonding in IECI magazine; Sep./Oct. 2009; p. 37.
Erico International Corporation; Instruction Sheet for Intersystem Bonding Termination; 2008; pp. 1-2.
Burndy; Advertisement for Burndy Bondit Intersystem Bonding; 2009 FCI USA, Inc.

* cited by examiner

*Primary Examiner* — Tulsidas C Patel
*Assistant Examiner* — Phuongchi Nguyen
(74) *Attorney, Agent, or Firm* — Ware, Fressola, Van Der Sluys & Adolphson LLP

(57) ABSTRACT

An intersystem grounding bridge and associated intersystem grounding bridge system includes a cylindrical housing formed from an electrically conductive material, the housing having a plurality of channels in a first face of the housing for receiving and holding grounding conductor wires of associated communication components, a plurality of threaded apertures in the cylindrical surface of the housing for receipt of set screws so as to secure grounding wires inserted within these first channels, and a second channel formed in a second face of the cylindrical housing for receiving a grounding and an associated grounding conductor wire. A second threaded aperture in the cylindrical housing in cooperates with the second channel to secure a grounding rod and, if present, the associated grounding conductor wire. The grounding bridge may include a cover to form an intersystem grounding bridge system.

18 Claims, 2 Drawing Sheets

INTERSYSTEM GROUNDING BRIDGE AND SYSTEM

TECHNICAL FIELD

The present invention relates to an intersystem grounding bridge and intersystem grounding bridge system. In particular, it is directed to a cylindrically shaped grounding bridge and an associated housing. Such an intersystem grounding bridge and system relate to electrical connectors and, more particularly, for bonding and securely grounding communication equipment directly with a grounding rod.

BACKGROUND OF THE INVENTION

Section 250.94 of the National Electrical Code (NEC) is directed to electrical grounding and bonding of communication equipment. This code section is applicable to all types of buildings and structures, including residential, commercial and industrial structures. The purpose of the code section is to provide a common grounding point due to the increased use of sensitive electronic equipment in many types of structures and therefore requiring bonding of the ground conductors associated with such equipment to reduce the overall potential difference between the various ground conductors. Such reduction in potential difference is particularly important when a structure is subject to lightning strikes and the like. The code section requires lightning protection systems, communication equipment, radio, television, cable and satellite systems to be bonded (grounded) together so as to minimize the electrical potential between such devices.

In particular, National Electrical Code 250.94 requires an intersystem grounding device that provides the means for connecting communication system grounding conductors and bonding conductors at service equipment or at disconnecting means for buildings or structures supplied by a feeder or branch circuit and specifically requires an identifiable physical termination point to which all such devices and systems are to be bonded. There has therefore been development of intersystem grounding devices for providing such grounding and bonding termination of communication equipment and the like. In many such installations, there is an electrical grounding rod to which the intersystem grounding bridge is electrically terminated along with an associated electrical grounding conductor which in turn provides grounding termination to an electrical box and the like on the outside of a structure. The NEC code requires that electrical grounding conductors from such communication equipment be terminated with such an intersystem grounding bridge.

There is therefore a need for an intersystem grounding bridge and system which is easy to use by electricians and which facilitates termination of ground conductors from communication equipment and the like to the grounding bridge so as to provide for compliance with the NEC code.

Thus, in any particular installation or location, various conduits or cables must be interconnected to each other as well as connected to the primary power supply in a suitable power distributing outlet box, junction box, meter box, or other enclosure. In these instances, flexible metal conduit and/or armor or metal clad cables within which the electrical power carrying wires are contained, must be securely mounted to the housing of a junction box or outlet box, or connected to an appropriate solid or rigid metal tubing or conduit.

In addition, in order to assure that the installed conduits or cables and the electrical power carrying wires contained therein are properly and safely installed for operation, power distributing outlet boxes, junction boxes, meter boxes, and other similar enclosures typically incorporate grounding conductors which are interconnected to the power supply and extend from the particular box to a properly installed grounding rod/conductor or remote grounded location. In this way, all of the power carrying wires installed in the particular home or building are properly connected to a grounded location.

In 2008, various Articles of the National Electric Code (NEC) were rewritten to define new requirements for Intersystem Bonding Termination. In this regard, requirements for installing a bonding connection point for communication systems were specifically defined. Due to the numerous instances in which homes, electrical systems, electronic equipment, communication equipment, and the like were destroyed or severely damaged by uncontrolled events such as lightning, power surges, etc., the new requirements were established to provide an effective and reliable intersystem bonding termination which should reduce or eliminate the difficulties and damage that has been encountered.

In accordance with the new requirements, including Section 250.94 of the NEC, an intersystem bonding termination establishes a device which provides a connecting point for communication equipment grounding and bonding. In achieving this goal, the intersystem bonding terminations must employ either (1) a set of terminals mounted and electrically connected to a meter enclosure, or (2) a bonding bar near the service or meter equipment and closure or close to the raceway for the service conductors, or (3) the installation of a bonding bar near the grounding electrode conductor.

Although these requirements have been in existence for several years, commercially available products which are capable of achieving the desired mounted connections are generally limited and expensive. Typically, these prior art products incorporate components which are expensive to manufacture due to tolerance requirements for enabling these components to be secured to the desired grounding rod/grounding conductor. Consequently, a need exists in the industry for the production of effective products, such as bonding bars or grounding bridges, which are capable of being employed to satisfy the requirements for the intersystem bonding termination and are capable of being manufactured inexpensively, while also providing a high quality, highly effective and easily employed product.

Therefore, it is a principal object of the present invention to provide an intersystem grounding bridge and system which is easy to install in any desired location, especially such an intersystem grounding bridge and system that includes a cover to protect the connections from the environment and tampering.

A further object of the present invention is to provide an intersystem grounding bridge system having a cover which is easy to slidably move relative to the grounding bridge, which in a first position surrounds the grounding bridge so as to minimize tampering of the intersystem grounding bridge system after installation and to provide environmental protection to the overall system after installation, and in a second position, is moved away from the grounding bridge to facilitate installation or removal of electrical conductors and/or grounding rod relative to the grounding bridge.

A further object of the present invention is an intersystem grounding bridge and system that has a cylindrical housing forming the grounding bridge, the cylindrical housing configured with a plurality of channels on one face that are dimensioned for receiving and holding a grounding wire/conductor associated with a communication system component and further having a second channel formed in the cylindrical housing through a second face, the channel dimensioned for receiving a grounding rod and an associated electrical grounding conductor.

A still further object of the present invention is an intersystem grounding bridge and system that includes a viewing port in the cylindrical housing forming the grounding bridge, the viewing port facilitating visual inspection of bonding of the grounding rod and, if present, the associated electrical grounding conductor to the grounding bridge.

SUMMARY OF THE INVENTION

An embodiment of the present invention is an intersystem grounding bridge system comprising a cylindrical housing formed from an electrically conductive material so as to form an intersystem grounding bridge, the cylindrical housing having first and second faces, a plurality of first channels formed therein spaced along a longitudinal axis of the housing and positioned around the first face of the housing, the channels dimensioned for receiving and holding a grounding wire associated with a communication system component, a plurality of threaded apertures formed in a cylindrical surface of the cylindrical housing, each threaded aperture of the plurality of threaded apertures in cooperating association with one of said first channels and dimensioned for receiving a threaded set screw for enabling said set screw to be advanced into securing engagement with a grounding conductor wire inserted in said first channel, a second channel formed in the cylindrical housing through the second face of the housing, the channel dimensioned for receiving a grounding rod and an associated grounding conductor wire, a second threaded aperture formed in the cylindrical surface of the cylindrical housing in cooperating association with the second channel and dimensioned for receiving a threaded bolt for enabling said bolt to be advanced into securing engagement with said grounding rod and, if present, said associated electrical grounding conductor wire; and a cover having openings at each end, the cover dimensioned to slidably move relative to said cylindrical housing, so as to surround said cylindrical housing when in a first position, and to be away from said cylindrical housing, when in a second position.

A further embodiment of the present invention is an intersystem grounding bridge system, further comprising a viewing port formed in the cylindrical housing, the viewing port extending into the region of the second channel so as to allow for viewing of the connection of the grounding rod and/or associated electrical grounding conductor wire within said channel.

Another embodiment of the present invention is an intersystem grounding bridge system, wherein the second channel has a first portion having a generally U-shaped configuration and a second portion with a generally V-shaped configuration, the U-shaped configuration portion dimensioned for receipt of a grounding rod and the V-shaped portion dimensioned for receipt of an associated electrical grounding conductor wire.

Another embodiment of the present invention is an intersystem grounding bridge system, wherein the cylindrical housing is fabricated from bronze.

Another embodiment of the present invention is an intersystem grounding bridge system, wherein the cover is fabricated from plastic.

Another embodiment of the present invention is an intersystem grounding bridge system, further comprising a mechanism for fastening the cover to the cylindrical housing when the cover is in the first position.

Another embodiment of the present invention is an intersystem grounding bridge comprising a cylindrical housing formed from an electrically conductive material so as to form said intersystem grounding bridge, the cylindrical housing having first and second faces, a plurality of first channels formed therein spaced along a longitudinal axis of the housing and positioned around the first face of the housing, the channels dimensioned for receiving and holding a grounding conductor wire associated with a communication system component, a plurality of threaded apertures formed in a cylindrical surface of the cylindrical housing, each threaded aperture of the plurality of threaded apertures in cooperating association with one of said first channels and dimensioned for receiving a threaded set screw for enabling said set screw to be advanced into securing engagement with a grounding conductor wire inserted in said first channel, a second channel formed in the cylindrical housing through the second face of the housing, the channel dimensioned for receiving a grounding rod and an associated grounding conductor wire, a second threaded aperture formed in the cylindrical surface of the cylindrical housing in cooperating association with the second channel and dimensioned for receiving a threaded bolt for enabling said bolt to be advanced into securing engagement with said grounding rod and, if present, said associated electrical grounding conductor wire.

Another embodiment of the present invention is an intersystem grounding bridge, further comprising a viewing port formed in the cylindrical housing, the viewing port extending into the region of the second channel so as to allow for viewing of the connection of the grounding rod and/or associated electrical grounding conductor within said channel.

Another embodiment of the present invention is an intersystem grounding bridge system, wherein the second channel has a first portion having a generally U-shaped configuration and a second portion with a generally V-shaped configuration, the U-shaped configuration portion dimensioned for receipt of a grounding rod and the V-shaped portion dimensioned for receipt of an associated electrical grounding conductor wire.

DETAILED DESCRIPTION

Figure 1:
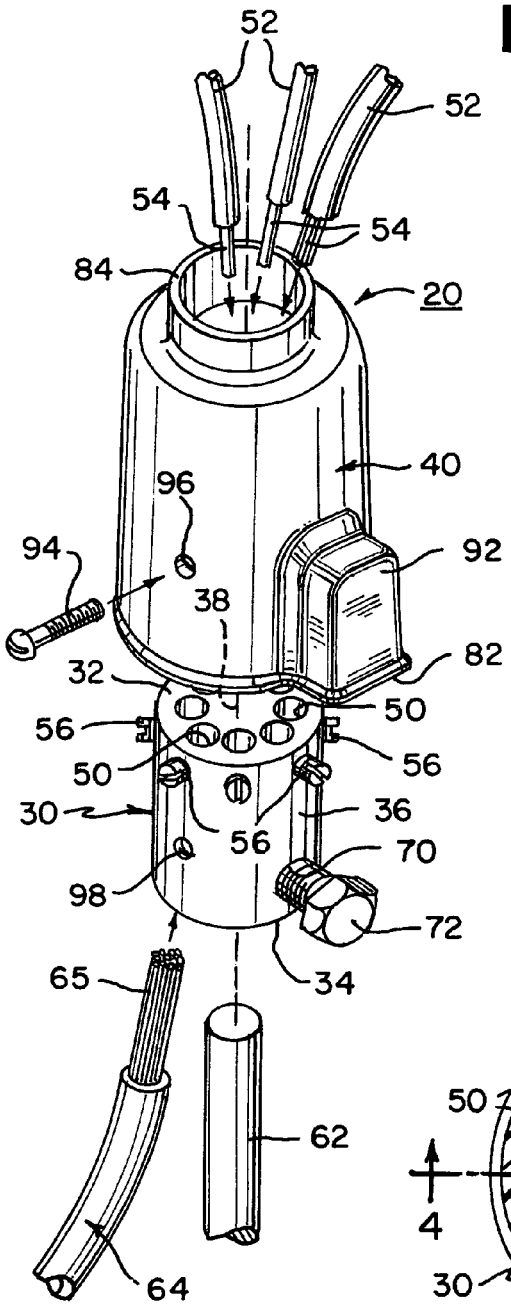
FIG. 1 is an exploded perspective view of the intersystem grounding bridge system according to the present invention showing the cylindrical housing and the cover associated with the intersystem grounding bridge and system, as well as the electrical grounding wires/conductors associated with communication system components, a grounding rod, and an associated grounding conductor.

FIG. 1 is an exploded perspective view of an embodiment of an intersystem grounding bridge system 20 according to the present invention. The intersystem grounding bridge system includes a cylindrically shaped housing 30 that forms a grounding bridge and a cover 40. As used herein, the terms cylindrical housing and intersystem grounding bridge are synonymous. The cylindrical housing is formed from an electrically conductive material, such as copper or brass, and has a first face 32, a second face 34 (see also FIGS. 4 and 6), and a cylindrical surface 36 positioned along axis 38. The cylindrical housing includes a plurality of channels 50 formed in the first face 32, these channels dimensioned for receipt of an electrical grounding wire 54 of a conductor 52 associated with a communication system component. As seen in FIG. 1, the conductors may be insulated with the wire 54 inside the insulation.

Figure 4:
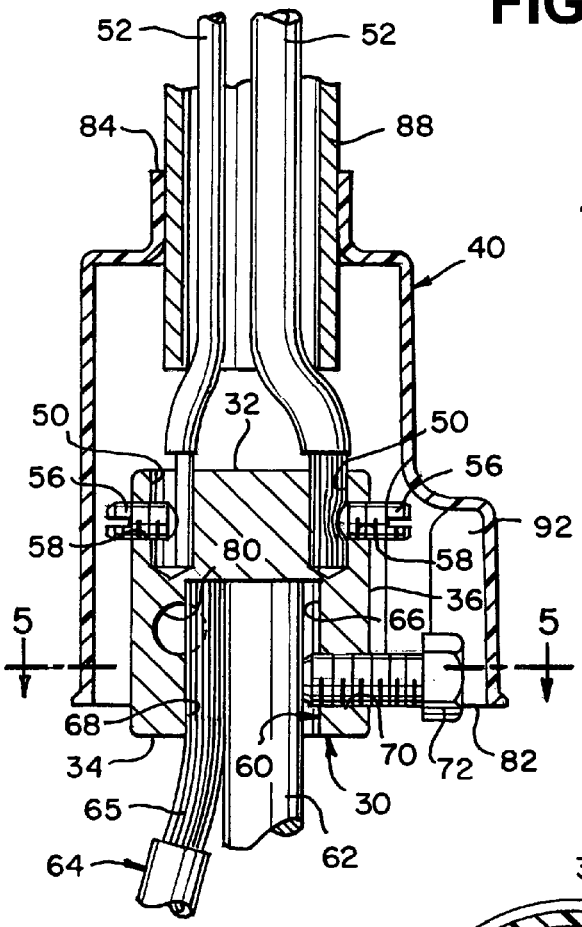
FIG. 4 is a cross-sectional view of the intersystem grounding bridge system, the cross-sectional view in the orientation of the intersystem grounding bridge system shown in FIG. 2.

FIG. 4 shows that the channels 50 extend within the cylindrical housing for a sufficient depth to receive the electrical wires 54 of the electrical conductors.

FIG. 4 also shows that the electrical wires can have different diameters and yet are still secured to the cylindrical housing by means of set screws 56 which threadedly engage within threaded apertures 58 formed within the cylindrical portion of the cylindrical housing and in cooperating association with one of the channels 50. The overall configuration is best seen in FIG. 4 after installation of the grounding conductor wires 54 of the associated communication equipment.

Figure 5:
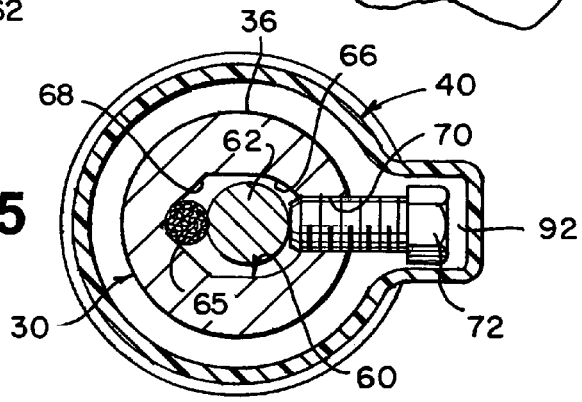
FIG. 5 is a cross-sectional view taken along line 5-5 of FIG. 4 of the intersystem grounding bridge system.

As best seen in FIGS. 4 and 5, the bottom face 34 of the cylindrical housing has a second channel 60 formed therein, the second channel dimensioned for receipt of a grounding rod 62, as well as an associated electrical grounding conductor 64 with an electrical wire 65 for termination to an electrical outlet box or the like. As seen in FIG. 1, the conductor wire 65 may be insulated with the wire 54 inside the insulation. The second channel can have a generally U-shaped cross-section 66 in a first region thereof as best seen in FIG. 5, as well as a V-shaped region 68 as also shown in FIG. 5. The V-shaped region is particularly dimensioned for receipt of the associated electrical wire 65 while the U-shaped region is particularly dimensioned for receipt of an electrical grounding rod 62.

Similar to the channels 50 formed in the first face of the cylindrical conductor, the second channel 60 also has an associated aperture 70 formed in the cylindrical housing which extends to the second channel 60. This aperture 70 is threaded so as to receive a bolt 72, which when threadedly engaged in the second aperture 70, secures the grounding rod 62 and associated wire 65 of conductor 64 to the cylindrical housing. This is best seen in FIG. 5.

This configuration of the cylindrical housing facilitates installation by readily accepting grounding wires/conductors associated with communication equipment into channels 50 of the cylindrical housing (grounding bridge) after the grounding bridge is secured to the electrical grounding rod 62 and associated conductor 64. This arrangement maintains a fixed orientation for receipt of such electrical conductors 52. This also provides for easy addition or removal of electrical conductors 52 upon adding or removing a communication system component to an associated structure requiring such an electrical conductor 52.

In order to insure proper installation of the electrical grounding rod 62 and associated wire 65 within the second channel 60, a viewing port 80 is provided in the cylindrical housing for facilitating visual inspection of the grounding rod and associated conductor after installation. This is best seen in FIGS. 4 and 6.

As seen in FIGS. 1, 2, 4, and 6, cover 40 is dimensioned for slidably moving in the directions of arrow 90 so as to easily surround cylindrical housing 30 in a first position or to move away from the housing to facilitate installing conductors 52 and to allow viewing through viewing port 80 when in a second position. To achieve this sliding capability, the cover has a lower open terminating end 82 and an upper open terminating end 84. The cover can be configured as shown in cross-section in FIG. 4 so as to enclose the mounting bolt 72, as well as the set screws 56. The upper terminating end 84 of the cover is dimensioned to position around a channel member 88 which may be used to enclose the grounding wires 52. This channel member 88 is optional and thus the cover can effectively surround the terminating ends of the conductors 52 when positioned over the intersystem grounding bridge cylindrical housing as shown in FIG. 4 even without the channel member.

Figure 2:
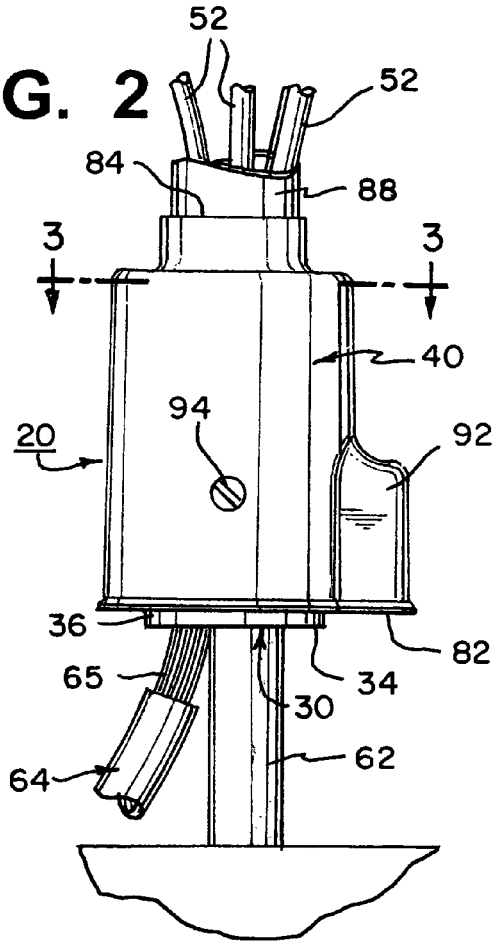
FIG. 2 is a side view of the intersystem grounding bridge system as shown in FIG. 1 after its installation.
Figure 3:
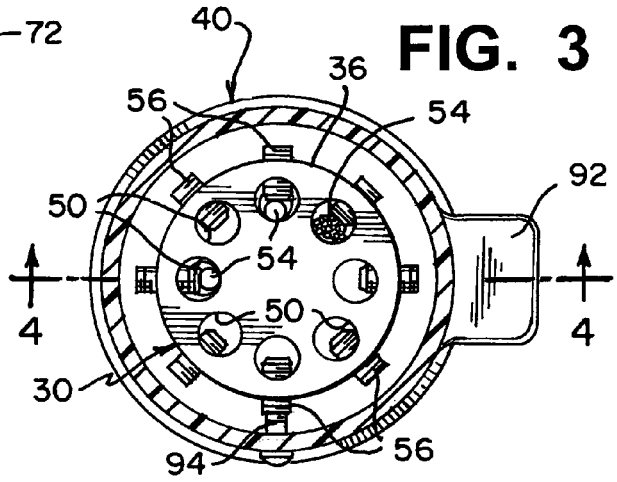
FIG. 3 is a cross-sectional view of the intersystem grounding bridge system taken along line 3-3 of FIG. 2.
Figure 6:
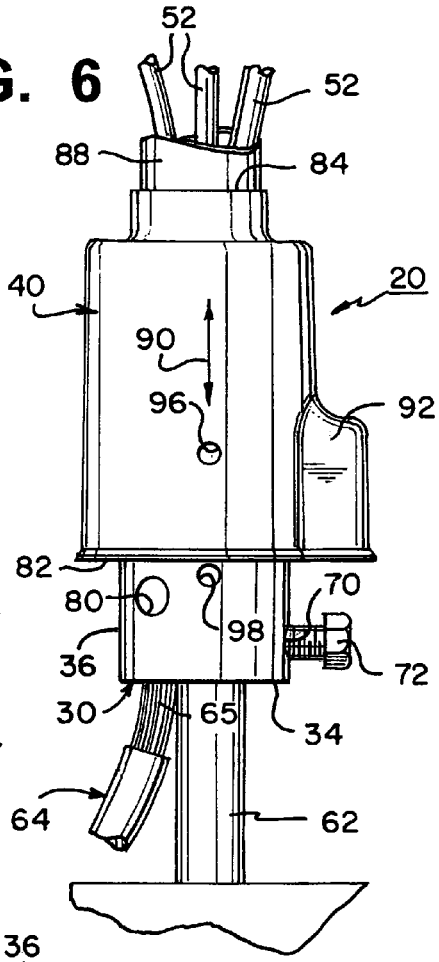
FIG. 6 is a side view of the intersystem grounding bridge system similar to FIG. 2, but showing the cover slidably moved partially away from the cylindrical housing forming the intersystem grounding bridge and thereby showing how the cover is slidably placed around the cylindrical housing or removed therefrom so as to facilitate installation of the communication equipment conductors, electrical grounding rod and associated conductor to the intersystem grounding bridge.

FIG. 6 shows the manner in which the cover can be readily slid in the directions shown by arrow 90 so as to allow access to the cylindrical housing when adding or removing conductors from the cylindrical housing. The cover can then be readily slid back so as to surround the cylindrical housing when such maintenance is complete, as seen in FIGS. 2 and 4.

FIGS. 1-6 also show that the cover can include an extension member 92 which is shaped so as to cover mounting bolt 72. Other configurations of the cover are readily apparent to those skilled in the art. The cover can be fabricated from any type of material that is environmentally stable, such as from a plastic material that is easily molded. The cover may be secured to the electrical housing by means of a set screw 94 positioned through an aperture 96 in the cover and which engages the cylindrical housing in a threaded region 98. Other types of features may be used, such as a pin or rivet.

The overall result is an intersystem grounding bridge and system which greatly facilitates compliance with Section 250.94 of the National Electrical Code and which provides for environmental protection of the intersystem grounding bridge through use of the associated cover of the system.

Therefore, the overall construction of the present invention allows for easy bonding of grounding wires/conductors associated with communication equipment to the grounding rod/conductor and the associated electrical grounding conductor of the power distribution box.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto. Furthermore, in the claims means-plus-function clauses are intended to cover the structures described herein as performing the recited function and not only structural equivalents, but also equivalent structures. Thus although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. An intersystem grounding bridge system comprising:

a cylindrical housing formed from an electrically conductive material so as to form an intersystem grounding bridge, the cylindrical housing having:

first and second faces, a plurality of first channels formed therein spaced along a longitudinal axis of the housing and positioned around the first face of the housing, the channels dimensioned for receiving and holding a grounding conductor wire associated with a communication system component, a plurality of threaded apertures formed in a cylindrical surface of the cylindrical housing, each threaded aperture of the plurality of threaded apertures in cooperating association with one of said first channels and dimensioned for receiving a threaded set screw for enabling said set screw to be advanced into securing engagement with a grounding conductor wire inserted in said first channel, a second channel formed in the cylindrical housing through the second face of the housing, the channel dimensioned for receiving a grounding rod and an associated grounding conductor wire, a second threaded aperture formed in the cylindrical surface of the cylindrical housing in cooperating association with the second channel and dimensioned for receiving a threaded bolt for enabling said bolt to be advanced into securing engagement with said grounding rod and, if present, said associated electrical grounding conductor wire; and a cover having openings at each end, the cover dimensioned to slidably move relative to said cylindrical housing, so as to surround said cylindrical housing when in a first position, and to be away from said cylindrical housing, when in a second position.

2. The intersystem grounding bridge system according to claim 1, wherein the second channel has a first portion having a generally U-shaped configuration and a second portion with a generally V-shaped configuration, the U-shaped configuration portion dimensioned for receipt of a grounding rod and the V-shaped portion dimensioned for receipt of an associated electrical grounding conductor wire.

3. The intersystem grounding bridge system according to claim 1, wherein the cylindrical housing is fabricated from bronze.

4. The intersystem grounding bridge system according to claim 1, wherein the cover is fabricated from plastic.

5. The intersystem grounding bridge system according to claim 1, further comprising a viewing port formed in the cylindrical housing, the viewing port extending into the region of the second channel so as to allow for viewing of the connection of the grounding rod and/or associated electrical grounding conductor wire within said channel.

6. The intersystem grounding bridge system according to claim 5, wherein the second channel has a first portion having a generally U-shaped configuration and a second portion with a generally V-shaped configuration, the U-shaped configuration portion dimensioned for receipt of a grounding rod and the V-shaped portion dimensioned for receipt of an associated electrical grounding conductor wire.

7. The intersystem grounding bridge system according to claim 6, wherein the cylindrical housing is fabricated from bronze.

8. The intersystem grounding bridge system according to claim 6, wherein the cover is fabricated from plastic.

9. The intersystem grounding bridge system according to claim 6, further comprising means for fastening the cover to the cylindrical housing when the cover is in the first position.

10. The intersystem grounding bridge system according to claim 1, further comprising means for fastening the cover to the cylindrical housing when the cover is in the first position.

11. The intersystem grounding bridge according to claim 10, further comprising a viewing port formed in the cylindrical housing, the viewing port extending into the region of the second channel so as to allow for viewing of the connection of the grounding rod and/or associated electrical grounding conductor within said channel.

12. The intersystem grounding bridge according to claim 11, wherein the second channel has a first portion having a generally U-shaped configuration and a second portion with a generally V-shaped configuration, the U-shaped configuration portion dimensioned for receipt of a grounding rod and the V-shaped portion dimensioned for receipt of an associated electrical grounding conductor wire.

13. The intersystem grounding bridge according to claim 12, wherein the cylindrical housing is fabricated from bronze.

14. The intersystem grounding bridge according to claim 12, wherein the cover is fabricated from plastic.

15. An intersystem grounding bridge comprising:

a cylindrical housing formed from an electrically conductive material so as to form said intersystem grounding bridge, the cylindrical housing having:

first and second faces, a plurality of first channels formed therein spaced along a longitudinal axis of the housing and positioned around the first face of the housing, the channels dimensioned for receiving and holding a grounding conductor wire associated with a communication system component, a plurality of threaded apertures formed in a cylindrical surface of the cylindrical housing, each threaded aperture of the plurality of threaded apertures in cooperating association with one of said first channels and dimensioned for receiving a threaded set screw for enabling said set screw to be advanced into securing engagement with a grounding conductor wire inserted in said first channel, a second channel formed in the cylindrical housing through the second face of the housing, the channel dimensioned for receiving a grounding rod and an associated grounding conductor wire, a second threaded aperture formed in the cylindrical surface of the cylindrical housing in cooperating association with the second channel and dimensioned for receiving a threaded bolt for enabling said bolt to be advanced into securing engagement with said grounding rod and, if present, said associated electrical grounding conductor wire.

16. The intersystem grounding bridge according to claim 15, further comprising a first portion having a generally U-shaped configuration and a second portion with a generally V-shaped configuration, the U-shaped configuration portion dimensioned for receipt of a grounding rod and the V-shaped portion dimensioned for receipt of an associated electrical grounding conductor wire.

17. The intersystem grounding bridge according to claim 16, wherein the cylindrical housing is fabricated from bronze.

18. The intersystem grounding bridge according to claim 16, wherein the cover is fabricated from plastic.

* * * * *